US012252898B2

(12) United States Patent
Zhao et al.

(10) Patent No.: US 12,252,898 B2
(45) Date of Patent: Mar. 18, 2025

(54) PREFABRICATED INFILLED PANEL-FRAME STRUCTURE CAPABLE OF ACCOMMODATING SEISMIC LOADING AND SEISMIC ENERGY DISSIPATION, AND CONSTRUCTION METHOD

(71) Applicants: SOUTH CHINA UNIVERSITY OF TECHNOLOGY, Guangzhou (CN); CHINA CONSTRUCION FOURTH ENGINEERING DMSION GREEN BUILDING TECHNOLOGY (GUANGDONG), LTD, Guangdong (CN); CHINA CONSTRUCTION FOURTH ENGINEERING DIVISION CORP. LTD, Guangdong (CN); BEIJING BRACE DAMPING ENGINEERING TECHNOLOGY CO., LTD, Beijing (CN)

(72) Inventors: Junxian Zhao, Guangzhou (CN); Hao Qin, Guangzhou (CN); Xiangkun Yao, Guangzhou (CN); Zhi Luo, Guangzhou (CN); Kezhu Jiang, Guangzhou (CN); Guohui Yuan, Guangzhou (CN); Weijie Chen, Guangzhou (CN); Wei Han, Guangzhou (CN)

(73) Assignees: SOUTH CHINA UNIVERSITY OF TECHNOLOGY, Guangzhou (CN); CHINA CONSTRUCION FOURTH ENGINEERING DMSION GREEN BUILDING TECHNOLOGY (GUANGDONG), LTD, Guangdong (CN); CHINA CONSTRUCTION FOURTH ENGINEERING DIVISION CORP. LTD, Guangdong (CN); BEIJING BRACE DAMPING ENGINEERING TECHNOLOGY CO., LTD, Beijing (CN)

( * ) Notice: Subject to any disclaimer, the term of this patent is extended or adjusted under 35 U.S.C. 154(b) by 0 days.

(21) Appl. No.: 18/720,670

(22) PCT Filed: Mar. 24, 2023

(86) PCT No.: PCT/CN2023/083721
§ 371 (c)(1),
(2) Date: Jun. 17, 2024

(87) PCT Pub. No.: WO2024/124735
PCT Pub. Date: Jun. 20, 2024

(65) Prior Publication Data

US 2024/0417992 A1 Dec. 19, 2024

(30) Foreign Application Priority Data

Dec. 13, 2022 (CN) ..... 202211595650.6

(51) Int. Cl.
*E04B 2/74* (2006.01)
*E04H 9/00* (2006.01)
(Continued)

(52) U.S. Cl.
CPC ..... *E04H 9/021* (2013.01); *E04H 9/024* (2013.01); *E04B 1/98* (2013.01); *E04B 2/56* (2013.01);
(Continued)

(58) Field of Classification Search
None
See application file for complete search history.

(56) References Cited

U.S. PATENT DOCUMENTS 3,842,558 A * 10/1974 Scholz ..... E04C 2/044 52/293.3
3,958,388 A * 5/1976 Hawes ..... E04B 9/26 52/800.1
(Continued)

FOREIGN PATENT DOCUMENTS

| | | |
|---|---|---|
| CN | 107338870 | 11/2017 |
| CN | 109838031 | 6/2019 |

(Continued)

OTHER PUBLICATIONS

Zhao Junxian et al., "Seismic performance of sliding gusset connections in buckling-restrained braced steel frame", Journal of Building Structures, Feb. 2019, submit with English abstract, pp. 117-127.

(Continued)

*Primary Examiner* — Phi D A
(74) *Attorney, Agent, or Firm* — JCIPRNET

(57) ABSTRACT

The present invention relates to a prefabricated infilled panel-frame structure capable of accommodating seismic-loading and seismic energy dissipation, and a construction method thereof, including a frame body, a prefabricated infilled panel group, a panel connector, and a disc spring assembly. During an earthquake, the present invention slides to dissipate energy only after the maximum starting sliding force is exceeded, thus providing the structure with a relatively high lateral stiffness prior to sliding. After an earthquake, the disc spring assembly of the present invention may provide a certain restoring force due to being compressed so as to reduce the residual displacement. Further, the present invention achieves the bidirectional deformation cooperation of the prefabricated infilled panel under earthquakes, so that the infilled panel may still achieve the function of seismic energy dissipation under the coupling action of in-plane and out-of-plane loads.

18 Claims, 10 Drawing Sheets

(51) Int. Cl.

| | |
|---|---|
| ***E04H 9/02*** | (2006.01) |
| *E04B 1/98* | (2006.01) |
| *E04B 2/56* | (2006.01) |
| *E04H 9/16* | (2006.01) |

(52) U.S. Cl.
CPC ..... *E04B 2/74* (2013.01); *E04B 2/7401* (2013.01); *E04B 2/7407* (2013.01); *E04H 9/025* (2013.01); *E04H 9/16* (2013.01)

(56) References Cited

U.S. PATENT DOCUMENTS

| | | | | | |
|---|---|---|---|---|---|
| 5,065,558 | A * | 11/1991 | Boatsman | E04B 1/34315 | 52/848 |
| 5,832,678 | A * | 11/1998 | Newcomb | E04H 9/021 | 52/79.8 |
| 6,021,992 | A * | 2/2000 | Yen | F16F 7/08 | 248/560 |
| 2007/0186497 | A1* | 8/2007 | Burkett | E04B 2/7401 | 52/259 |
| 2008/0098670 | A1* | 5/2008 | Hsu | E04H 9/021 | 52/167.4 |
| 2015/0135617 | A1* | 5/2015 | Liu | E04B 2/7448 | 52/302.1 |
| 2016/0194867 | A1* | 7/2016 | Ahmadi | E04H 9/025 | 52/167.7 |
| 2019/0100935 | A1* | 4/2019 | Staszczyk | E04B 1/08 | |

FOREIGN PATENT DOCUMENTS

| | | |
|---|---|---|
| CN | 112900673 | 6/2021 |
| CN | 114737696 | 7/2022 |
| CN | 114934614 | 8/2022 |
| CN | 115387506 | 11/2022 |
| DE | 2525459 A1 * | 7/1975 |
| JP | H0960010 | 3/1997 |
| JP | 2001059360 | 3/2001 |
| JP | 2011006966 | 1/2011 |

OTHER PUBLICATIONS

Zhao Junxian et al., "Subassemblage tests of buckling-restrained braced RC frame with sliding gusset connection", Journal of Building Structures, Jun. 2022, submit with English abstract, pp. 207-218.

"International Search Report (Form PCT/ISA/210) of PCT/CN2023/083721," mailed on May 16, 2023, pp. 1-5.

"Written Opinion of the International Searching Authority (Form PCT/ISA/237) of PCT/CN2023/083721," mailed on May 16, 2023, pp. 1-4.

* cited by examiner

PREFABRICATED INFILLED PANEL-FRAME STRUCTURE CAPABLE OF ACCOMMODATING SEISMIC LOADING AND SEISMIC ENERGY DISSIPATION, AND CONSTRUCTION METHOD

CROSS-REFERENCE TO RELATED APPLICATION

This application is a 371 of international application of PCT application serial no. PCT/CN2023/083721, filed on Mar. 24, 2023, which claims the priority benefit of China application no. 202211595650.6, filed on Dec. 13, 2022. The entirety of each of the above mentioned patent applications is hereby incorporated by reference herein and made a part of this specification.

TECHNICAL FIELD

The present invention belongs to the technical field of civil building seismic energy dissipation, and relates to a frame structure with prefabricated seismic energy dissipation infilled wall, and in particular to a prefabricated infilled panel-frame structure capable of accommodating seismic-loading and seismic energy dissipation, and construction method.

BACKGROUND ART

Infilled wall-frame structure is one of the main structures in China, which is composed of beams, columns, and infilled walls. It has the advantages of light weight and flexible space separation. In this structural type, the infilled wall is considered to be a kind of self-bearing non-structural member, which does not bear the vertical load of the main structure. Therefore, the infilled wall is usually input to the beam as a linear load in the structural design. The amplification effect of the infilled wall on the lateral stiffness of the structure is approximately considered in the way of periodic reduction. However, this method is still based on bare frame design, and it does not consider the deformation and bearing capacity of the infilled wall.

The previous earthquake disaster reports show that the infilled wall and the main frame structure are subjected to collaborative forces and work together, and the infilled wall often act as the "first line of defense" under the earthquake, resulting in serious damage, as shown in FIG. 1. The infilled wall and the main frame structure have a strong interaction, which easily causes the main structure to have short column damage. This is contrary to the realization of "strong column and weak beam" design concept. The infilled wall damage is not only an important component of economic loss in earthquakes, but also an important reason for the rapid recovery of building function.

At present, some progress has been made in the research on the seismic performance of the traditional infilled wall-frame structure under earthquakes. The seismic performance of the infilled wall may be improved by setting vertical columns, horizontal tied beams, multi-ribbed frames, tie bars in the infilled wall, sticking carbon fiber reinforced sheets (CFRPs), and painting new cement-based materials on the surface of the infilled wall. In order to further reduce the life and economic losses caused by an earthquake, the existing research and technical solutions aim at damage control of a infilled wall and providing an additional seismic energy dissipation for the structure. The infilled wall is usually subjected to multiple transverse (or vertical) divisions to form a damping infilled wall with multiple panel units, and friction materials, viscoelastic layers, or metal dampers and other materials (or elements) are provided between the panel units. Under the action of horizontal earthquakes, the horizontal (or vertical) seams between the panel units will dissipate seismic energy due to the dislocation deformation.

In summary, it may be found that the existing research and technical solutions may improve the seismic performance of the infilled wall and have a certain seismic energy dissipation effect. However, the above-mentioned technical solutions still have the following problems to be further considered and solved.

1. Low prefabricated ratio of infilled wall. As shown in FIG. 2, the damping infilled wall proposed in the prior art solution is generally composed of a plurality of panel units. The panel units need to be formed by block masonry at the construction site. Therefore, the sliding seams between the panel units also need to be installed and laid at the construction site, which has the disadvantage of a low degree of wall assembly. Furthermore, compared with the vertical strip type prefabricated panels which are mostly used at present, the prefabricated damping infilled walls in the solutions of prior art usually adopt transverse panels. The difference in the form of the panels will result in incompatibility with the existing construction process. In particular, as shown in FIG. 3, when installing transverse damping infilled panel units within a frame of a large span, it is often difficult to achieve a transverse continuity splice between the transverse damping infilled panel units. Therefore, the damping infilled wall of prior art is generally suitable for building with a small span, and is difficult to adapt to requirements of the current large-span and large-space buildings.

2. Weak structural lateral resistance capacity. The traditional infilled wall and frame body often have a reliable connection to avoid the wall out-of-plane collapse, so that the infilled wall has a certain degree of lateral resistance capacity. Under the actual seismic action, the infilled wall and the frame body share the horizontal load. In addition, reasonable consideration of the lateral resistance capacity of the infilled wall still contributes to improving the ductility of the structure and reducing the cross-sectional size of the main structural member. However, the lateral resistance of the damping infilled wall according to the solution of prior art is mainly determined by the shear stiffness of the damping layer between the panel units, which is much smaller than the lateral stiffness of the conventional wall. Therefore, the lateral resistance capacity is usually weak when the damping infilled wall adopts the prior art solution.

3. Difficult functional recovery after earthquakes. In the total post-earthquake repair cost, the economic and time cost for repairing the post-earthquake infilled wall and water-electric-heating pipeline is usually large, and the recovery is difficult. As previously stated, the prior art solution divides the infilled wall into a plurality of panel units by providing transverse sliding seams at different heights of the wall. However, the water-electric-heating pipeline is often buried in the wall surface. When the structure is subjected to earthquakes, the panel units will form artificial sliding cracks along the transverse sliding seams, resulting in damage to the panel surface and the water-electric-heating pipeline. In addition, since the damping infilled wall according to the solution of prior art slides under the action of an earthquake, the residual displacement of the wall after the earthquake is large, and it is difficult to quickly recover to the pre-earthquake state (FIG. 4).

4. Poor ability in bidirectional deformation cooperation. In actual earthquakes, infilled walls are always subject to the coupling action of in-plane and out-of-plane loads, with in-plane damage affecting out-of-plane bearing capacity and out-of-plane damage affecting in-plane behavior. For regard to the vertical damping panel unit structure, the panel units are usually connected up and down by a pin shaft or a rigid connection. Thus, the panel units are easily damaged when there are in-plane and out-of-plane load coupling effects. With regard to the structure of the transverse damping panel unit, the panel unit thereof is usually reliably connected to the frame body only on one side. Therefore, the cooperation of the bidirectional deformation of the earthquake-reduction filled wall is not well considered. As shown in FIG. 5, the transverse damping panel unit according to the solution of prior art has the possibility of out-of-plane displacement only under in-plane action due to the unique construction form, which would bring about a great hidden danger to the out-of-plane safety. In addition, the above-mentioned phenomenon still further indicates that the out-of-plane bearing performance according to the solution of prior art is poor. Namely, once the damping infilled wall is subjected to the coupling action of in-plane and out-of-plane loads, the deformation and energy dissipation mechanism of the infilled wall along the sliding seam will be significantly changed, resulting in poor cooperation in bidirectional deformation.

SUMMARY OF THE INVENTION

The object of the present invention is to overcome the deficiencies of the prior art, and provide a prefabricated infilled panel-frame structure capable of accommodating seismic-loading and seismic energy dissipation, and a construction method thereof, which may improve the bidirectional deformation cooperation performance of a wall under in-plane and out-of-plane loads while ensuring the use function of a building, improving the construction quality and prefabricated ratio and increasing a certain of resistant-lateral rigidity capacity, so as to achieve multi-objective cooperation of resisting earthquake action (earthquake resistance) under an earthquake, dissipating seismic energy (earthquake dissipation), reducing infilled wall damage (damage control), and reducing structural residual displacement after the earthquake to reduce the repair cost (recoverable).

The technical solution provided by the present invention is shown in FIG. 6. Based on the existing seismic design method, the technical solution set an anti-seismic working state and a seismic energy dissipation working state.

When the prefabricated infilled panel-frame structure is subjected to frequently occurring earthquake (FOE, with an exceedance probability of 63% in 50 years), the prefabricated infilled panel and the main frame structure are in the working state of anti-seismic, and the structure keeps the elastic working state. As shown in the equivalent mechanical diagram of FIG. 7, the prefabricated infilled panel group does not have sliding hysteretic energy dissipation, and thus the prefabricated infilled panel may be equivalent to the double diagonal strut model in the frame body, which may provide a certain degree of lateral stiffness for the structure, help to limit the inter-story drift ratios (IDR) and ensure the normal function of the structure.

As shown in FIG. 8, when the prefabricated infilled panel-frame structure is subjected to rare earthquakes (RE with an exceedance probability of 2% in 50 years), the story shear force obtained by stiffness distribution of the infilled panel is further increased. When the panel overcomes the critical starting sliding force composed of the maximum pre-pressure of the disc spring assembly, the panel will generate sliding hysteretic energy dissipation along the bottom damping layer driven by the frame body, and the disc spring assembly will generate reciprocating compression deformation and consume a small amount of seismic input energy, so that the structure enters the working state of seismic energy dissipation. In this working state, the lateral stiffness of the structure decreases and the seismic input energy decreases, which will effectively avoid the wall damage. Furthermore, when the sliding hysteretic energy dissipation occurs, the interaction between the infilled wall and the frame is significantly released. The release of the interaction will effectively alleviate the problems, such as significant stiffness mutation, large displacement of the top layer, overrun of the displacement between the layers and irregular torsion caused by the discontinuous vertical arrangement and uneven planar arrangement of the infilled walls. In particular, when a wall is subjected to bidirectional loading, the prefabricated infilled panel proposed by the present invention will allow a certain out-of-plane rotation of the panel without affecting the in-plane sliding hysteretic energy dissipation performance of the panel while ensuring wall damage control and out-of-plane bearing capacity, as shown in FIG. 9.

After an earthquake, the damping infilled wall structure according to the solution of prior art usually has a large post-earthquake residual displacement of $\delta$ 0, as shown by the dotted line infilled wall-frame structure in FIG. 10. When the solution provided by the present invention is used, the disc spring assembly after an earthquake may provide a certain restoring force due to being in a compressed state, and the restoring force will effectively reduce the post-earthquake residual displacement $\delta$ 1 of the prefabricated infilled panel, i.e., $\delta 1 < \delta 0$.

In particular, in order to achieve the above-mentioned working mechanism and object, the present invention provides a seismic synergistic prefabricated infilled panel-frame structure, comprising a frame body, a prefabricated infilled panel group, a panel group fastener, a disc spring assembly and a U-shaped connector.

The prefabricated infilled panel group is disposed in the frame body; the panel group fastener is disposed between left and right sides of the top of the prefabricated infilled panel group and the frame body, and the disc spring assembly is disposed between left and right sides of the lower part thereof and the frame body; each disc spring assembly comprises a disc spring box, a disc spring, and a disc spring backing plate; the disc spring box is used for fixed connection with the frame body, and the disc spring is in a pre-pressed state; the disc spring is located in a cavity surrounded by a disc spring box and the disc spring backing plate; and the disc spring backing plate is movably arranged and is in contact with the prefabricated infilled panel group;

The prefabricated infilled panel group comprises a plurality of vertical sub-panels; adjacent vertical sub-panels are connected in a splicing manner; and the top of each vertical sub-panel is connected to the frame body via the U-shaped connector, and the bottom thereof is connected to the frame body via cast-in-place fine stone concrete. The connection of the prefabricated assembly type infilled panel group and the frame body comprises, in sequence from top to bottom, a panel group fastener, a U-shaped connector, a disc spring assembly, and a bottom cast-in-place fine stone concrete.

Furthermore, the frame body comprises a frame top beam, a frame bottom beam, a frame left column, and a frame right column, wherein the frame top beam and the frame bottom beam are equally long and parallel; and both ends of the frame top beam and the frame bottom beam are reliably connected to the frame left column and the frame right column, respectively.

Furthermore, the side wall of each vertical sub-panel is provided with a splicing ridge or a splicing groove, and the splicing ridge and the splicing groove may be spliced and fitted with each other; and the splicing connection between adjacent vertical sub-panels is realized by the mating of the splicing ridge and the splicing groove.

Furthermore, the vertical sub-panels are connected in a splicing manner using a panel splicing adhesive and the splicing ridge and the splicing groove.

Furthermore, each vertical sub-panel comprises a main board, an earthquake-reduction layer, and a secondary board arranged from top to bottom, wherein the bottom of the main board is provided with a semicircular groove; the top of the secondary board is provided with a semicircular ridge; the main board and the secondary board are connected by the semicircular groove and the semicircular ridge; the main board is rotatable along the semicircular ridge at the top of the secondary board; and the damping layer is disposed at the connection of the main board and the secondary board.

The semicircular groove at the bottom of the main board and the semicircular ridge at the top of the secondary board can be butt-connected. The main board may rotate along the semicircular ridge at the top of the secondary board to a certain extent. As shown in FIG. 9, the configuration of the semicircular groove and the semicircular ridge may ensure that the surface contact between the main board and the secondary board is always uniform, which helps to achieve the target of energy dissipation of the wall under bidirectional deformation.

Furthermore, the main board is located on the upper portion of the secondary board, and is connected to the semicircular ridge via the semicircular groove in a splicing manner. An damping layer is disposed at the connection between the main board and the secondary board. The damping layer may be made from a material with a energy dissipative function, such as SBS coiled materials or low-strength mortar.

Further, the bottom of the secondary board of each vertical sub-panel is further provided with a ridge for forming a shear key with the cast-in-place fine stone concrete, the shear key and the U-shaped connector cooperating to limit the out-of-plane displacement of the prefabricated infilled panel group.

Further, the prefabricated infilled panel group includes left vertical panels and right vertical panels, which are located on the left and right sides, and a plurality of middle vertical panels located between the left vertical panels and the right vertical panels.

Further, the left lower portion of the main board of the left vertical panel and the right lower portion of the main board of the right vertical panel are connected to the frame body via the disc spring assembly. The disc spring assembly is reliably connected to the frame. The disc spring is in a pre-pressed stat. The disc spring backing plate is in hard contact with the surface of the prefabricated infilled panel group, only providing a pushing force.

Further, the prefabricated infilled panel group is flexibly connected to other gaps of the frame body. The flexible connection may be filled and connected in a flexible connection manner recommended by a national standard or an industry standard.

Furthermore, the left vertical panel comprises a main board, an damping layer, and a secondary board. The left sides of the main board and the secondary board are straight and the right sides are provided with a splicing groove. The top of the main board is straight and the bottom is provided with a semicircular groove. The top of the secondary board is provided with a semicircular ridge and the bottom is provided with a ridge. A splicing ridge is provided on the left side of the plurality of middle vertical panels. The other arrangements are consistent with the left vertical panel. A splicing ridge is provided on the left side of the right vertical panel, the right side is straight, and the other arrangements are consistent with the left vertical panel.

Further, the left upper portion and the right upper portion of the prefabricated infilled panel group are connected to the frame via a panel group fastener. The panel group fastener is L-shaped and may be formed by casting in a formwork the fine stone concrete in the gap between left and right upper portions of the prefabricated infilled panel group and the frame body. The top of the prefabricated infilled panel group is connected to the frame body via a U-shaped connector. The bottom of the prefabricated infilled panel group is connected to the frame body via a cast-in-place bottom fine stone concrete. The pouring height of the cast-in-place fine stone concrete placed in the gap between the damping panel group and the frame left column and the frame right columns is kept flush with the top surfaces of the secondary boards of the plurality of vertical sub-panels. It should be noted that the out-of-plane stability of the prefabricated infilled panel-frame structure provided by the present invention is ensured by the shear key formed by the combination of the U-shaped connector and the cast-in-place bottom fine stone concrete and the secondary panel bottom ridge of the prefabricated infilled panel group, as shown in FIG. 11.

The present invention also discloses a method for constructing the prefabricated infilled panel-frame structure capable of accommodating seismic-loading and seismic energy dissipation, comprising the steps of:

step 1: completing the construction of frame body;

step 2: successively installing a left (or right) vertical sub-panel, a plurality of vertical sub-panels, and a right (or left) vertical sub-panel;

step 3, connecting the prefabricated infilled panel group and the frame body by casting fine stone concrete in a formwork;

step 4, installing disc spring assemblies on both sides of a lower portion of the prefabricated infilled panel group; and step 5, performing a flexible connection for a gap between the prefabricated infilled panel group and the frame body.

The invention has the following beneficial effects compared to prior art.

1. Improving the prefabricated ratio of infilled wall: the core unit of the prefabricated infilled panel capable of accommodating seismic-loading and seismic energy dissipation may be designed, produced and prefabricated in batches in a prefabricated factory. The connection and installation sequence of the prefabricated infilled panel group and the frame body are basically consistent with the existing construction process of the prefabricated panel so as to maximally ensure the installation quality and efficiency of the seismic synergistic prefabricated infilled panel-frame structure. In addition, the panel units in the novel prefabricated infilled panel-frame structure are vertical strip type panel units. The use of splicing connection between units is beneficial to ensure the continuity of splicing between panel units, so that they may be used in large-span and large-space buildings.

2. Increasing structural lateral resistance capacity: the disc spring assembly of the prefabricated infilled panel capable of accommodating seismic-loading and seismic energy dissipation is in a pre-pressed state, so that the sliding will occur along the damping layer only when the damping infilled wall overcomes the maximum starting sliding force. Compared with the prior art solutions, the present invention can provide a relatively high lateral stiffness for the structure before sliding so as to limit the IDR and achieve an anti-seismic working state.

3. Improving recoverability after earthquakes: the proposed prefabricated infilled panel could dissipate seismic input energy by providing a sliding damping layer between the main board and the secondary board in a prefabricated infilled panel group. Compared with the solutions of the prior art, the present invention avoids the disadvantages of forming a plurality of sliding seams in the middle of the wall to affect the arrangement of water-electric-heating pipelines of a building and the function of building use. In addition, the disc spring assembly is usually in a compressed state after the earthquake. Thus, it may provide a certain restoring force and reduce the residual displacement of the wall. Compared with the traditional infilled wall structure, the connection between the prefabricated infilled wall and the frame is mainly flexible. Thus, the lateral stiffness provided by the damping infilled wall is significantly reduced, which helps to release the infilled wall-frame interaction, realize the failure mechanism of "strong column and weak beam", reduce the "short column effect" and the sudden change of stiffness caused by the discontinuous arrangement of infilled wall along the height.

4. Bidirectional cooperative deformation energy dissipation: under the coupling action of in-plane and out-of-plane loads, the main board and secondary board of the prefabricated infilled panel-frame structure will slide uniformly (surface to surface contact) along the damping layer between the semicircular groove and the semi-circular ridge, so as to ensure the energy dissipation capacity of the wall under bidirectional cooperative deformation and solve the problems of low out-of-plane load bearing performance and poor bidirectional cooperative deformation of the previous technical solutions.

BRIEF DESCRIPTION OF THE DRAWINGS

In order to more clearly describe the technical solutions in the embodiments of the invention or the prior art, the drawings to be used in the description of the embodiments or the prior art will be briefly introduced below. It will be apparent to those skilled in the art that the drawings in the following description are some of the invention, and that other drawings may be obtained from the drawings without any creative works.

DETAILED DESCRIPTION OF THE INVENTION

Figure 1:
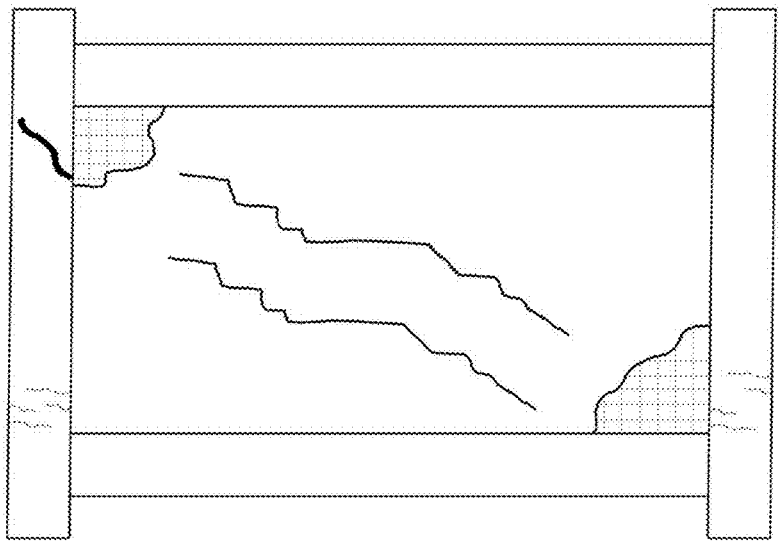
FIG. 1 is a graph of seismic vulnerability of a infilled wall.
Figure 2:
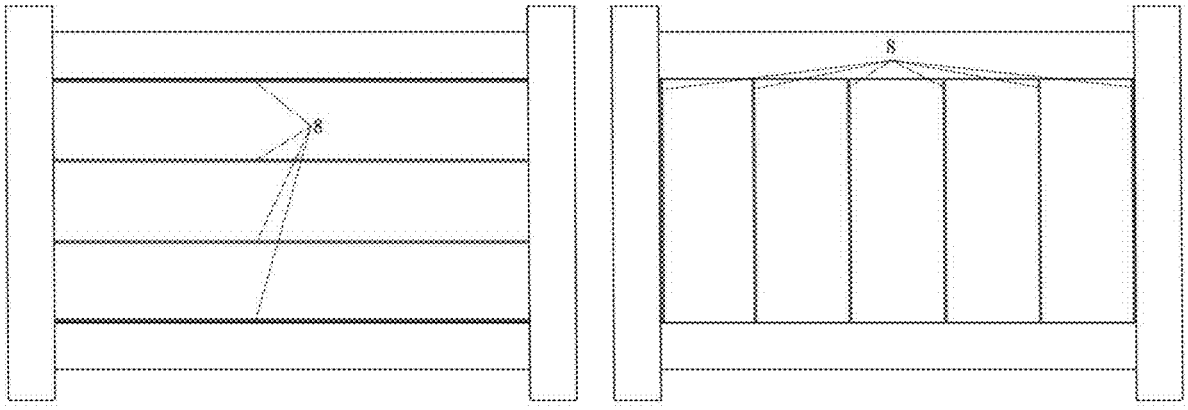
FIG. 2 is a schematic view of an damping infilled wall according to the solution of prior art.
Figure 3:
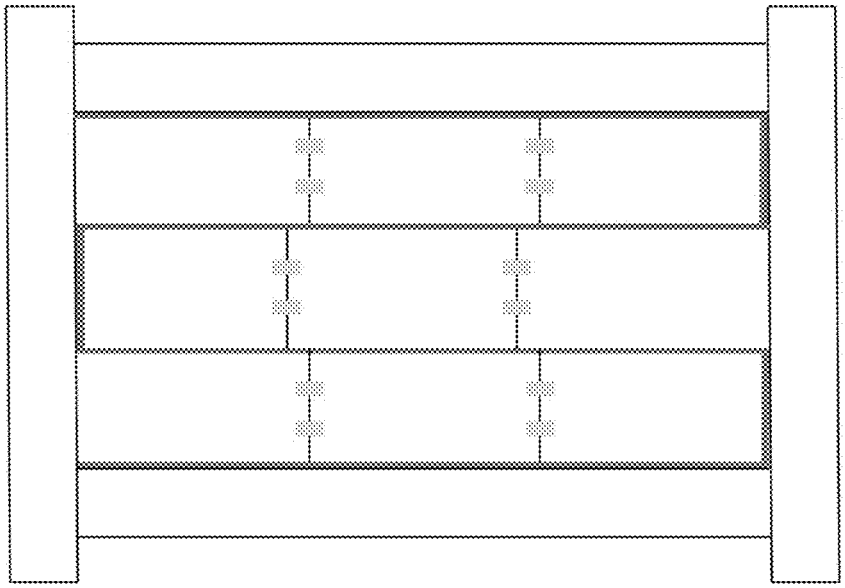
FIG. 3 is a schematic view for installing a transverse panel unit in a large-span frame according to the solution of prior art.
Figure 4:
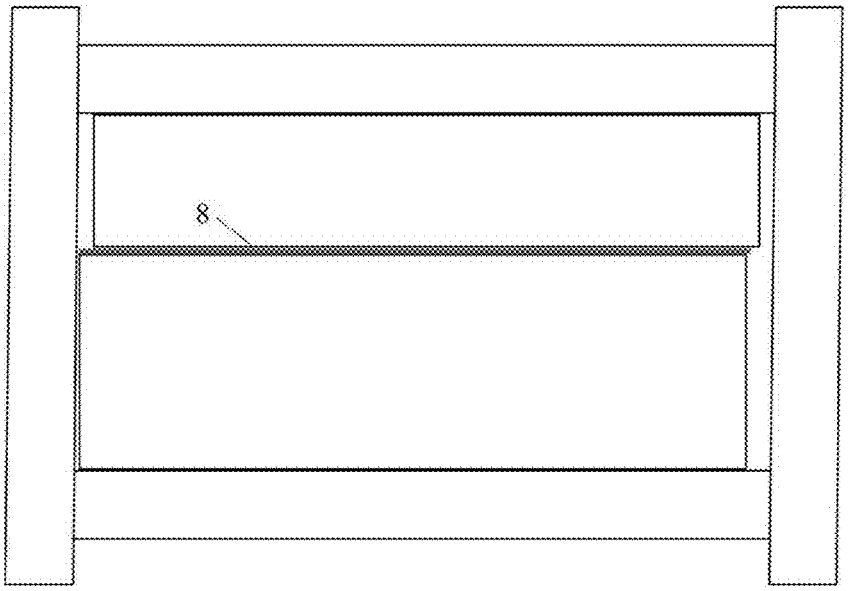
FIG. 4 is a schematic view of a post-earthquake residual displacement according to the solution of prior art.
Figure 5:
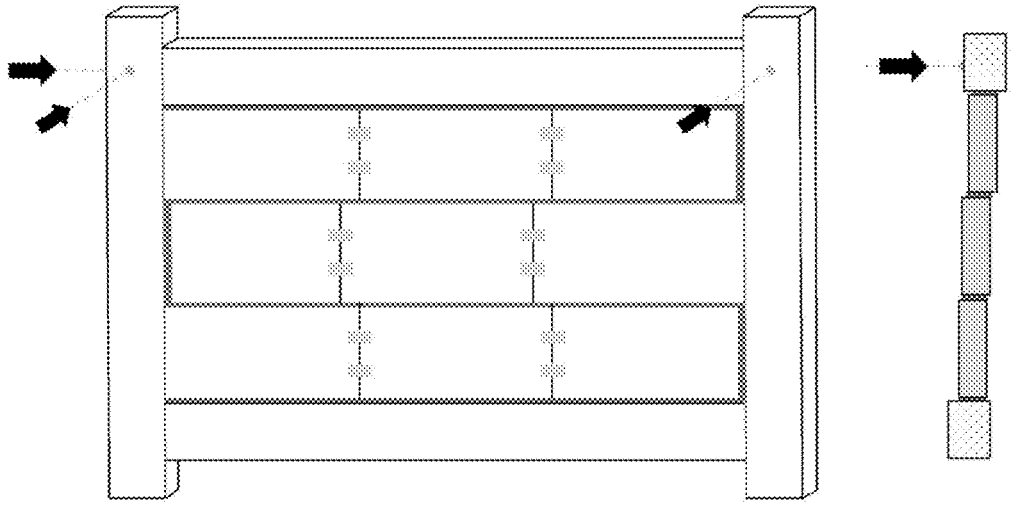
FIG. 5 is a schematic view showing the poor ability in bidirectional deformation cooperation according to the solution of prior art.

It should be noted that the following detailed description is exemplary and is intended to provide further explanation of the application. Unless defined otherwise, all technical and scientific terms used herein have the same meaning as commonly understood by one of ordinary skill in the art to which this application belongs.

It is noted that the terminology used herein is for the purpose of describing particular embodiments only and is not intended to be limiting of the exemplary embodiments in accordance with the present application. As used herein, the singular forms are intended to include the plural forms as well, unless the context clearly indicates otherwise. It should be understood that the terms "comprises" and/or "comprising", when used in this specification, specify the presence of features, steps, operations, elements, assemblies, and/or combinations thereof.

For ease of description, the words "upper", "lower", "left" and "right" in the present invention, if they appear in the upper, lower, left and right directions of the drawings themselves, are not meant to be limiting in structure, but merely to facilitate description of the invention and to simplify the description. They do not indicate or imply that the apparatus or elements referred to must have a particular orientation, are constructed and operated in a particular orientation, and are therefore not to be construed as limiting the invention.

Example 1

As shown in FIGS. 6-17, the present example provides a prefabricated infilled panel-frame structure, including a frame body in which a prefabricated infilled panel group is installed. The frame body includes a frame top beam 1, a frame bottom beam 2, a frame left column 3, and a frame right column 4. The frame top beam 1 is parallel to the frame bottom beam 2. The frame left column 3 is parallel to the frame right column 4. The left and right ends of the frame top beam 1 and the frame bottom beam 2 are reliably connected to the frame left column 3 and the frame right column 4 respectively.

The prefabricated infilled panel group includes a plurality of vertical sub-panels, which are arranged in sequence from left to right, and include a left vertical panel 5 and a right vertical panel 7 respectively located at the left and right outer sides, and a plurality of middle vertical panels 6 located between the left vertical panel 5 and the right vertical panel 7. The side wall of the vertical sub-panels is provided with a splicing ridge 14 or a splicing groove 13. An integral unit of the prefabricated infilled panel group is formed between adjacent vertical sub-panels by means of a panel splicing adhesive and a splicing connection between the splicing groove 13 and the splicing ridge 14. Each vertical sub-panel includes a main board, an damping layer, and a secondary board. Taking the left vertical panel 5 as an example, the left vertical panel 5 includes a left vertical panel main board 51 located above, a left vertical panel secondary board 52 located below, and an damping layer 8 located between the left vertical panel main board 51 and the left vertical panel secondary board 52. The earthquake-reduction layer 8 is adhered between a semicircular groove 15 at the bottom of the left vertical panel main board 51 and a semicircular ridge 16 at the top of the left vertical panel secondary board 52. The semicircular groove 15 and the semicircular ridge 16 may be inserted and fitted with each other. The left vertical panel main board 51 may rotate to some extent along the semicircular ridge 16 at the top of the left vertical panel secondary board 52. The left vertical panel 5 and the frame bottom beam 2 are connected via cast-in-place fine stone concrete 11. The left vertical panel 5 and the frame top beam 1 are connected via a U-shaped connector 12. The U-shaped connector 12 and the frame top beam 1 are connected via nailing. The U-shaped connector 12 and the left vertical panel 5 only contact at front and rear surfaces. The structures of the plurality of middle vertical panels 6, the right vertical panel 7 and the left vertical panel 5 are basically the same, and will not be repeated.

Among them, the bottom of each secondary board is further provided with a ridge. When the cast-in-place fine stone concrete 11 is solidified and hardened, a shear key will be formed with the ridge at the bottom of the secondary board, and the shear key at the bottom of the panel and the U-shaped connector 12 at the top may effectively limit the panel from having an out-of-plane displacement so as to improve the out-of-plane bearing performance.

The gaps between the left upper portion of the left vertical panel 5 and the frame body 2, and the right upper portion of the right vertical panel 7 and the frame body 2 are connected via a panel group fastener 9. The panel group fastener 9 is formed by casting fine stone concrete using a formwork, and is L-shaped. A disc spring assembly 10 is mounted between the left lower portion of the main board 51 of the left vertical panel in the left vertical panel 5 and the left column 3 of the frame, and between the right lower portion of the main board 71 in the right vertical panel 7 and the right column 4 of the frame. The disc spring assembly 10 includes a disc spring box 101, a disc spring 102, and a disc spring backing plate 103. The disc spring box 101 is connected to the frame body via nailing. The disc spring 102 is in a pre-pressed state. The disc spring backing plate 103 is only in hard contact with the surface of the earthquake-reduction panel group.

Under the action of the horizontal earthquake, the frame top beam 1 is displaced horizontally and driven by the panel group fastener 9 to cause the driven sliding tendency of the prefabricated infilled panel group. The disc spring 102 is compressed and deformed when the prefabricated infilled panel group overcomes the starting sliding force. The main board and the secondary board of the prefabricated infilled panel group have sliding hysteresis and deformation along the damping layer 8 to dissipate the seismic input energy. After the horizontal earthquake, the disc spring 102 is in the compressed state due to the residual displacement of the prefabricated infilled panel group after the earthquake. Thus, the disc spring 102 may provide a certain restoring force to reduce the residual displacement after the earthquake and reduce the time cost and economic cost of quickly restoring to the pre-earthquake state. In addition, when the structure is subjected to the out-of-plane load, the semicircular groove 15 at the bottom of the main board and the semicircular ridge 16 at the top of the secondary board of the prefabricated infilled panel will slide uniformly (surface to surface contact) along the damping layer 8 between the both and generate a certain amount of out-of-plane shear energy dissipation. When the structure continues to be subjected to the in-plane load, because the semicircular grooves 15 and the semi-circular ridges 16 still maintain uniform surface contact, stable sliding hysteretic energy dissipation may still occur in the surface, thus ensuring the cooperated deformation and energy dissipation of the wall under in-plane and out-of-plane load coupling.

Example 2

It is substantially the same as in Example 1, except that

The damping layer 8 is made of a material having function of energy dissipation, such as SBS coiled materials or low-strength mortar.

The frame body is a reinforced concrete frame or a steel frame.

Example 3

Figure 18:
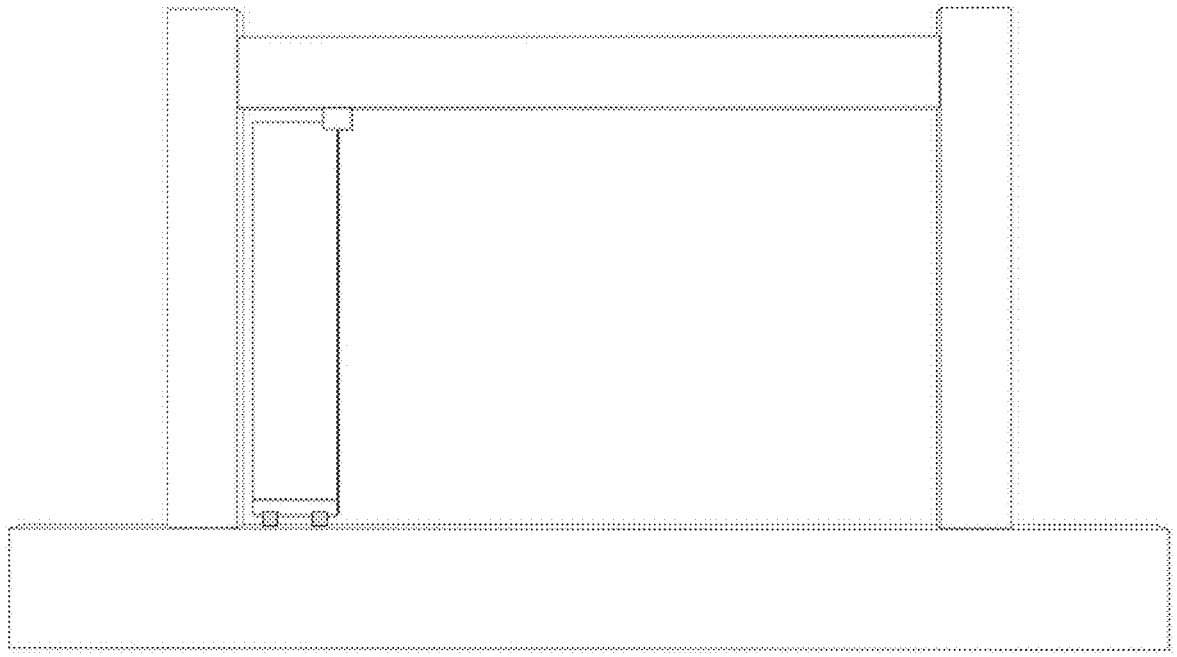
FIG. 18 is a schematic view of step 1 of Example 3 according to the present invention.
Figure 19:
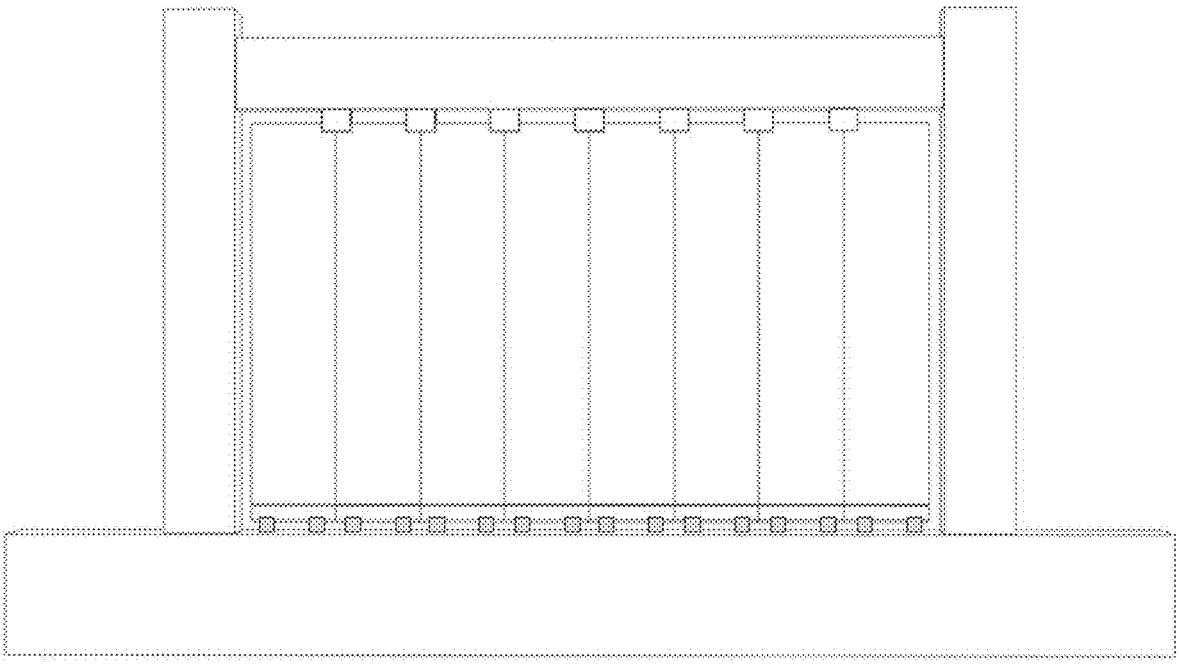
FIG. 19 is a schematic view of step 2 of Example 3 according to the present invention.
Figure 20:
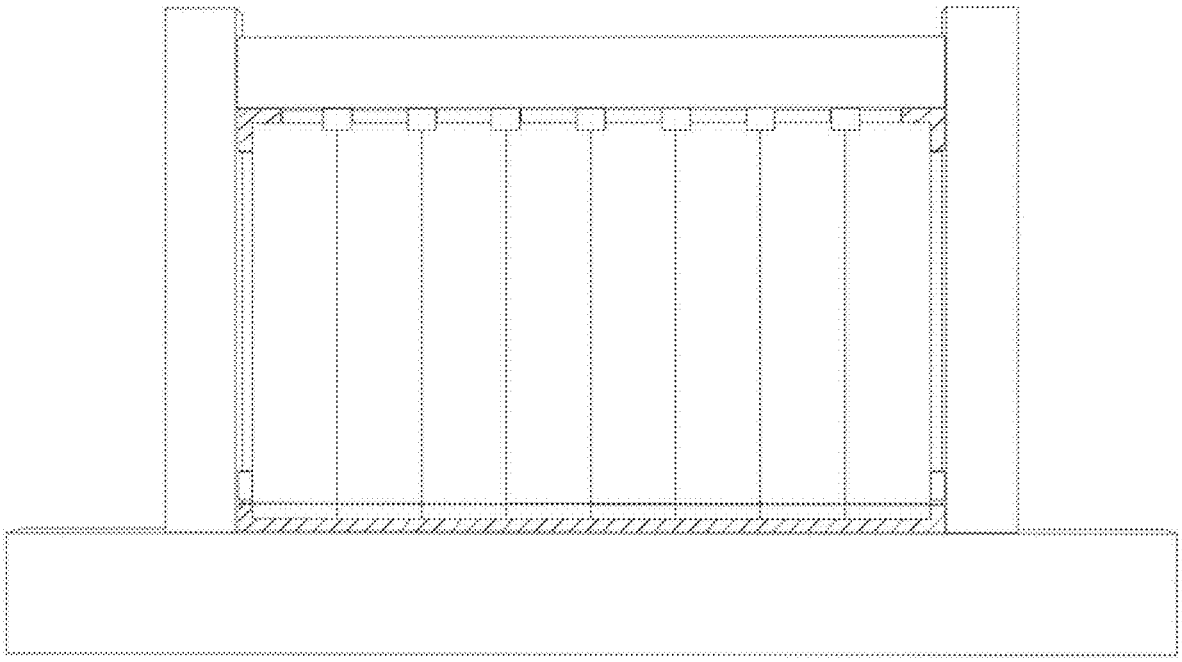
FIG. 20 is a schematic view of step 3 of Example 3 according to the present invention.

This example discloses a construction method for a prefabricated infilled panel-frame structure provided in the previous examples. As shown in FIGS. 18-20, before the assembly of the prefabricated infilled panel group, the construction of the frame body should be completed first. The impurities of the frame top beam and the frame bottom beam should be cleaned. The base surface leveling treatment should be performed. The panel installation location line is then popped out at a panel installation location according to the construction drawing to indicate the panel installation location.

The method for constructing the prefabricated infilled panel-frame structure includes the steps of:

Step 1:

According to a pre-marked infilled panel installation position, after the left vertical panel 5 is positioned, a U-shaped connector 12 is installed at the top thereof and a wood wedge is inserted at the bottom thereof. The installation schematic diagram is shown in FIG. 18. During the installing, the verticality of wall surface is adjusted by using a ruler, so that the lower edge of panel coincides with the installation position line of panel, so as to ensure that the verticality and flatness of panel meet the requirements of standards and specifications.

Step 2:

The step 1 process is repeated, with several middle vertical panels 6 and right vertical panels 7 successively installed and spliced. During the splicing, it firstly paints a panel splicing adhesive in the splicing groove 13 between adjacent vertical panels, and then splices the splicing groove 13 and the splicing ridge 14 so as to form an integral unit of prefabricated infilled panel group.

Figure 6:
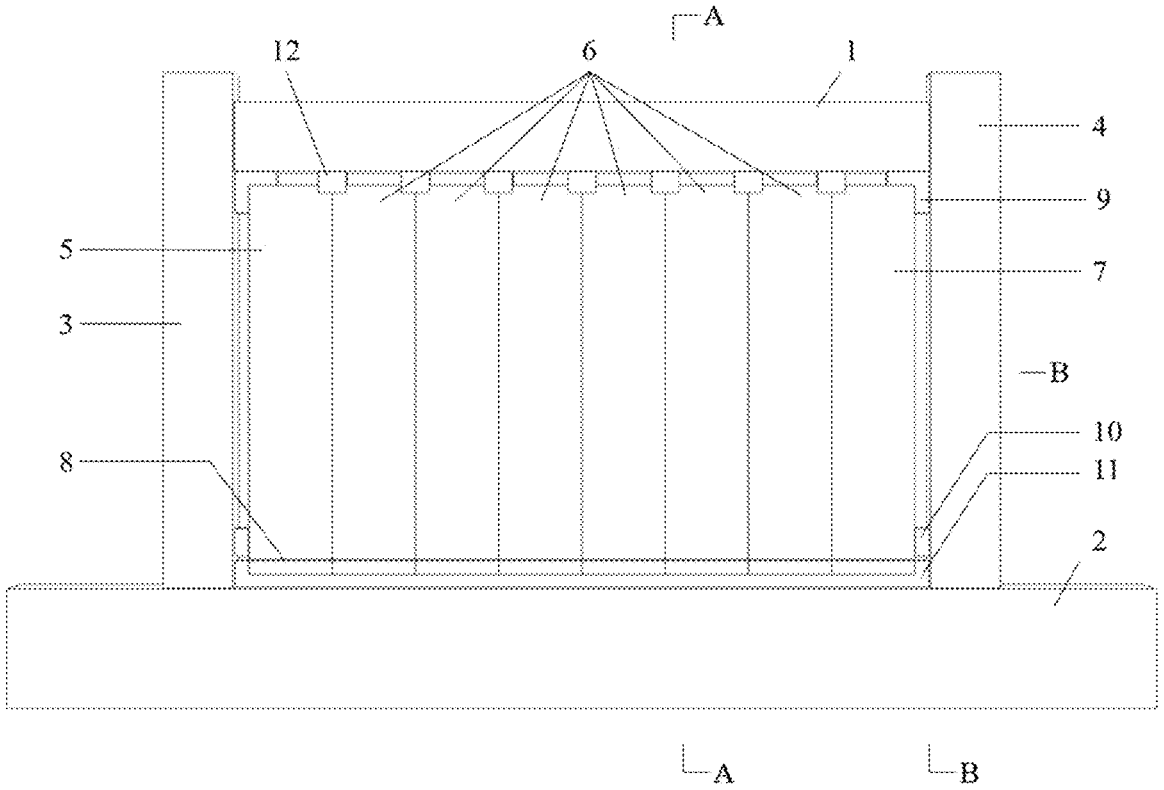
FIG. 6 is a schematic view showing an overall configuration of the present invention.
Figure 7:
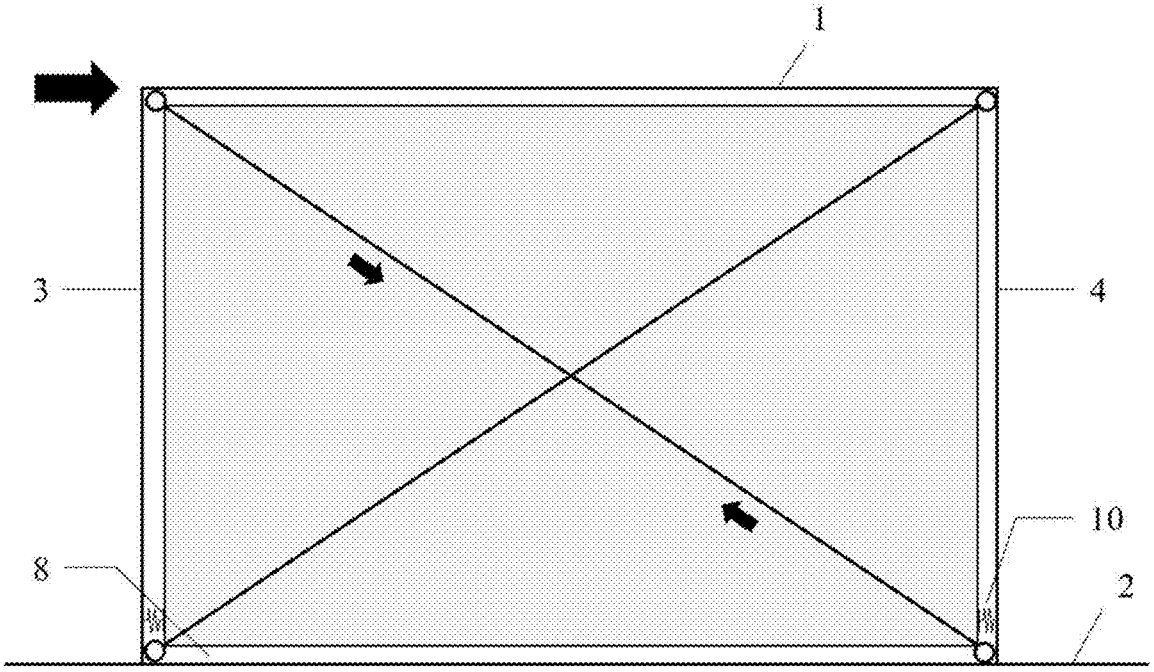
FIG. 7 is a schematic view of a bidirectional deformation cooperative configuration and mechanism of the present invention.
Figure 8:
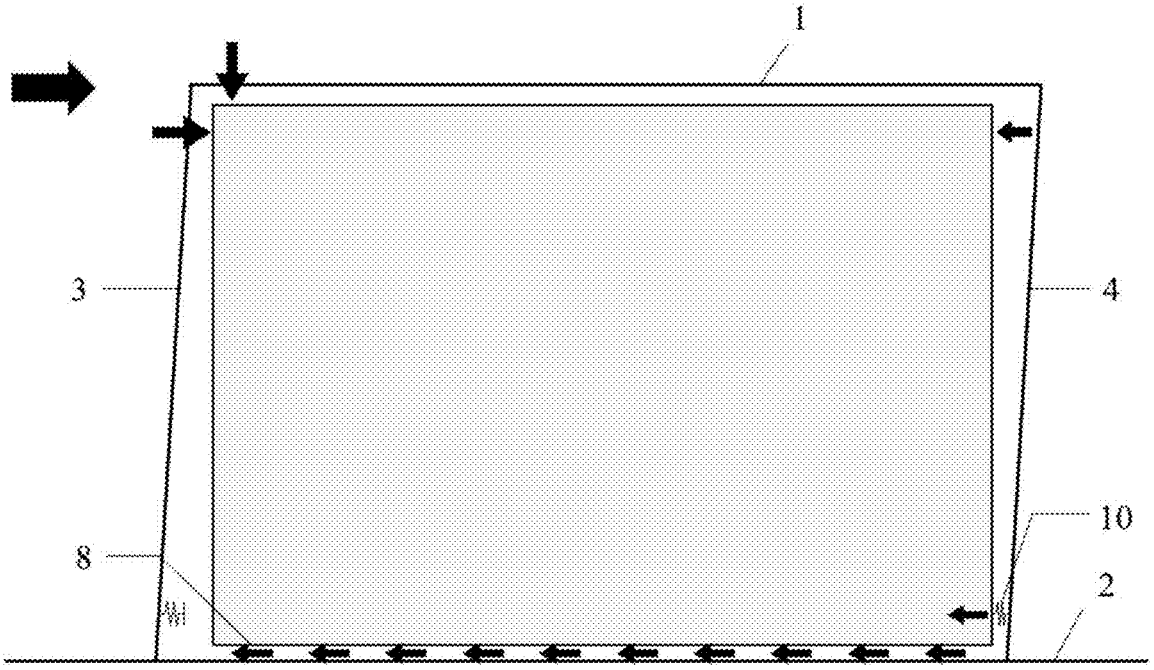
FIG. 8 is a schematic view showing equivalent mechanics in a anti-seismic working state according to the present invention.
Figure 9:
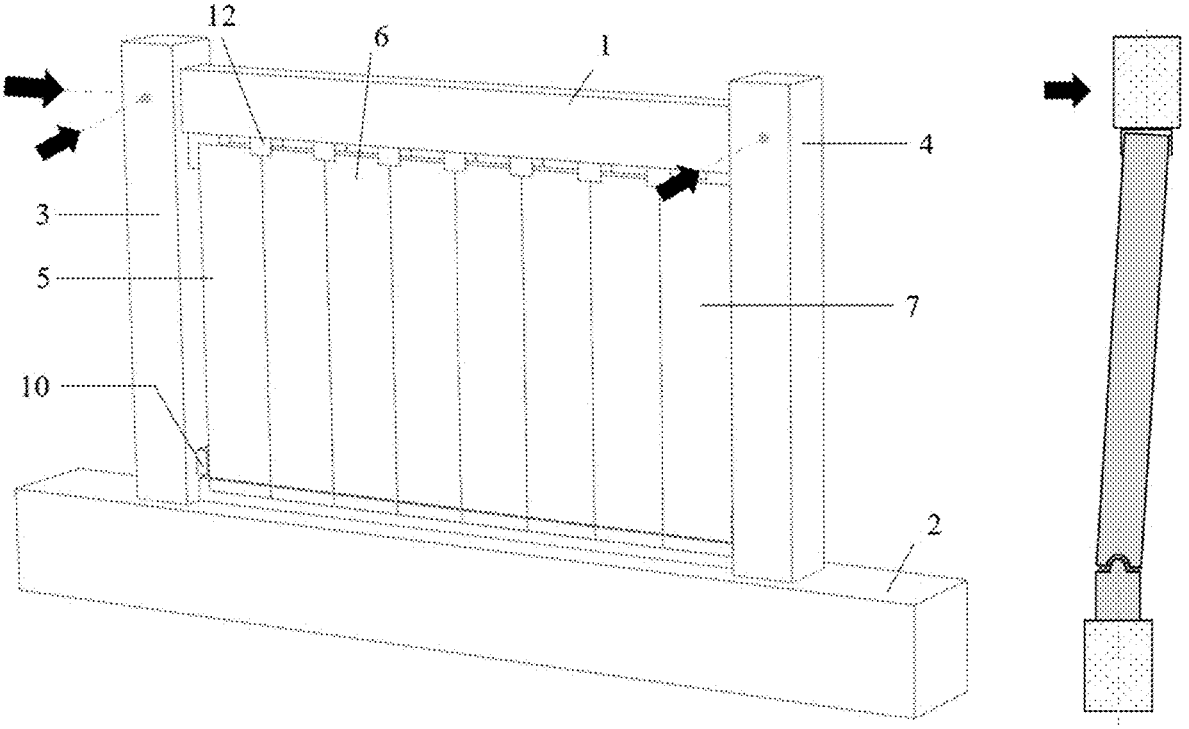
FIG. 9 is a schematic view showing equivalent mechanics a seismic enerygy disppation working state according to the present invention.
Figure 10:
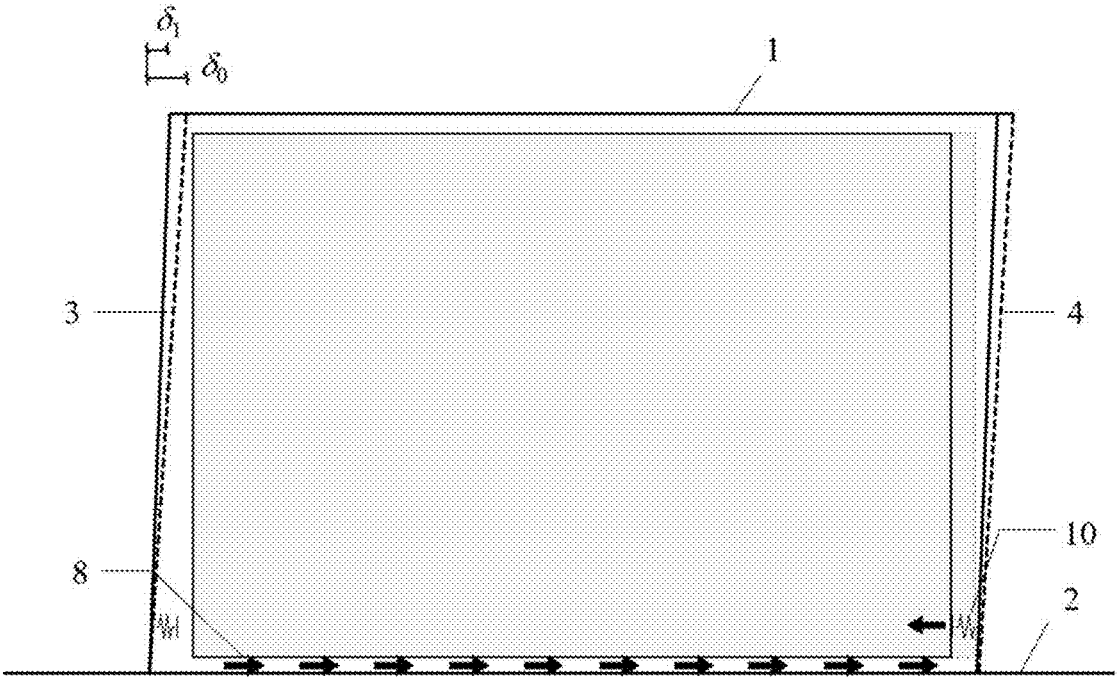
FIG. 10 is a schematic view of equivalent mechanics in a post-earthquake state according to the present invention.
Figure 11:
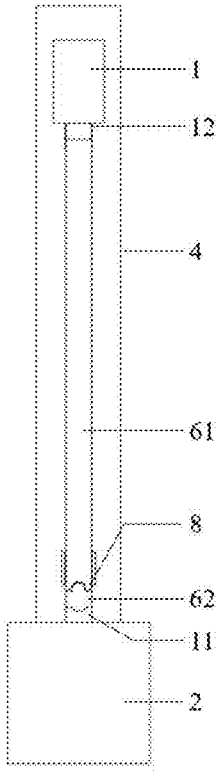
FIG. 11 is a schematic view of a configuration section A-A for ensuring out-of-plane stability according to the present invention.
Figure 12:
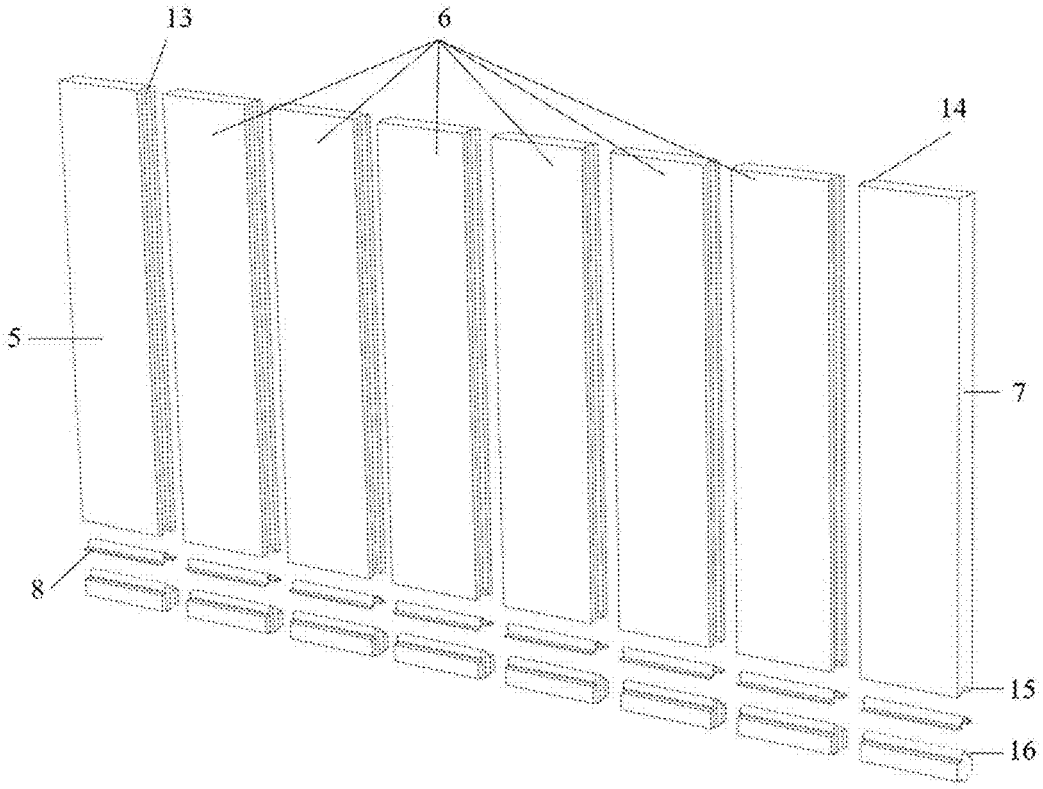
FIG. 12 is an exploded view of a prefabricated infilled panel group according to the present invention.
Figure 13:
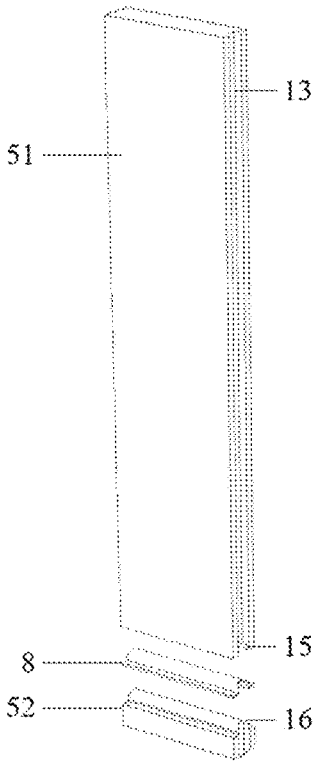
FIG. 13 is a schematic view of a left vertical panel configuration according to the present invention.
Figure 14:
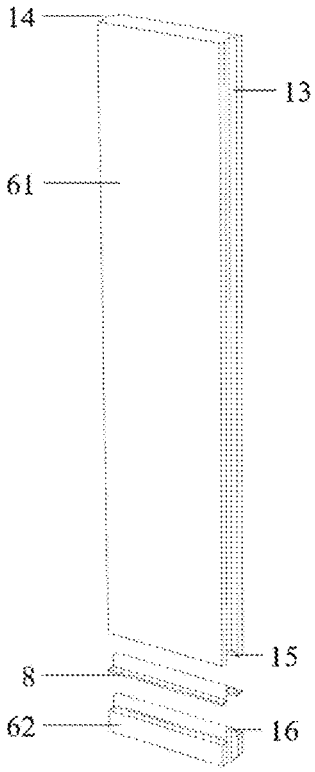
FIG. 14 is a schematic view of a plurality of middle vertical panels according to the present invention.
Figure 15:
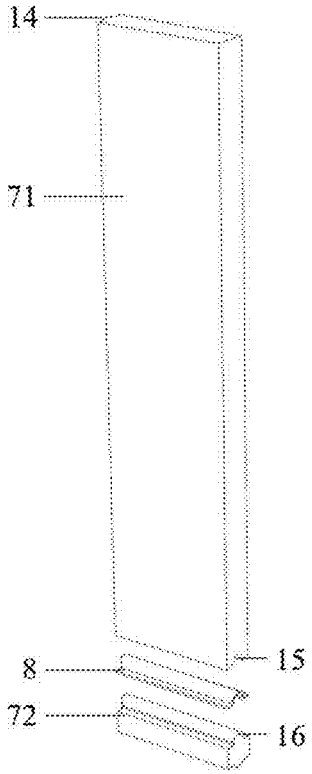
FIG. 15 is a schematic view of a right vertical panel configuration according to the present invention.
Figure 16:
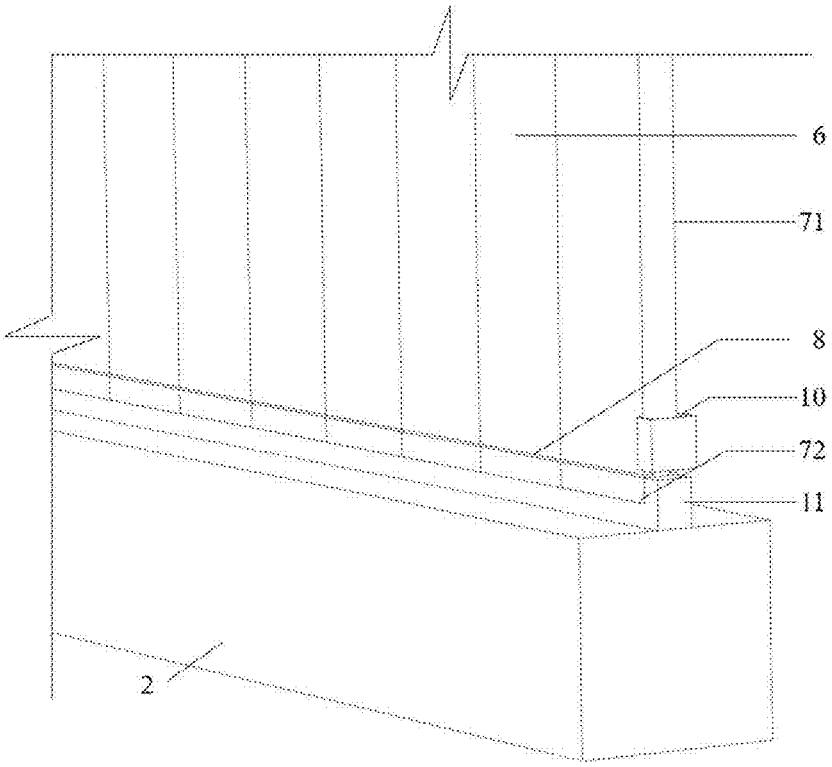
FIG. 16 is a cross-sectional view B-B showing the connection between the bottom of the prefabricated infilled panel group and the frame body according to the present invention.
Figure 17:
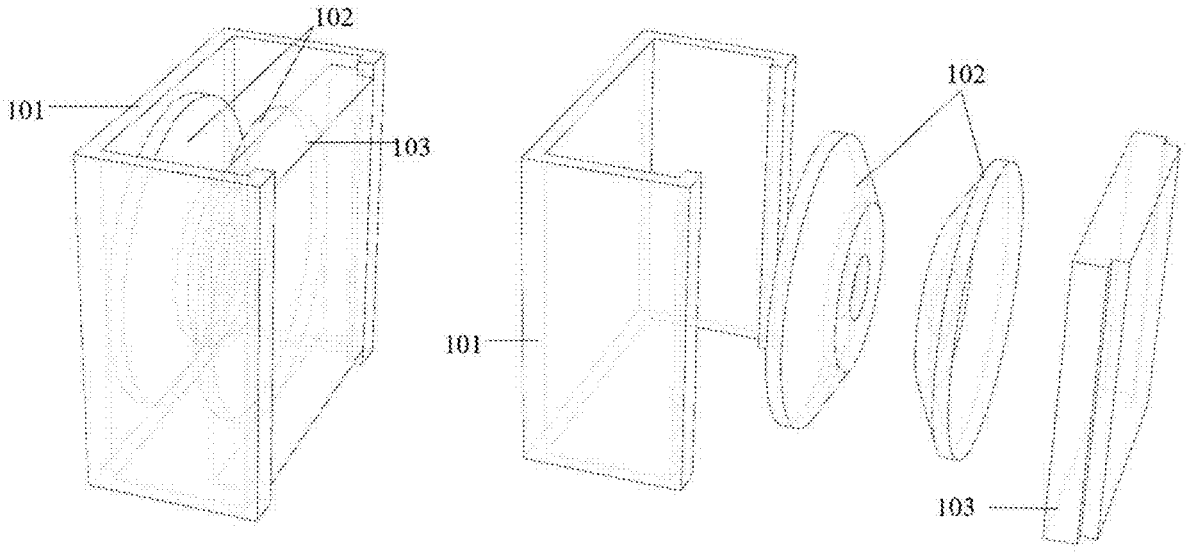
FIG. 17 is a schematic view of a spring assembly configuration according to the present invention.

Step 3:

The fine stone concrete was poured into the gap between the bottom of the prefabricated infilled panel group and the top of the frame bottom beam 2 after the splicing of the prefabricated infilled panel group is completed. During the pouring, it should ensure that the bottom of the cast-in-place fine stone concrete 11 completely fills the gap, and enabling the fine stone concrete to pour flush with the top of the secondary boards 51 and 71 at the gap between the prefabricated filled panel group and the frame left column 3 or right column 4. The schematic diagram of the pouring height of the gap is shown in FIG. 16. After the cast-in-place fine stone concrete 11 at the bottom is hardened, the bottom wood wedge is withdrawn and the fine stone concrete is filled at the hole left by the wood wedge. Furthermore, a panel group fastener 9 is formed by casting in a formwork the fine stone concrete at the left upper portion and the right upper portion of the prefabricated filled panel group. Further, a disc spring assembly 10 is installed at the bottom of one sides of the left vertical panel 5 and the right vertical panel 6 near to the frame body, respectively. The detailed installation position of the disc spring assembly 10 is schematically shown in FIGS. 6 and 16.

Step 4:

According to the requirements of moisture resistance, sound insulation, and thermal insulation, the other gaps between the prefabricated infilled panel and the frame body are filled and caulking with suitable flexible connecting materials.

Although the particular embodiments of the present invention have been described above with reference to the accompanying drawings, it is not intended to limit the scope of the present invention. It will be apparent to those skilled in the art that various modifications and variations made in the present invention without involving any inventive effort are still within the protection scope of the present invention.

What is claimed is:

1. A prefabricated infilled panel-frame structure capable of accommodating seismic-loading and seismic energy dissipation, comprising a frame body, a prefabricated infilled panel group, a panel group fastener, a disc spring assembly and a U-shaped connector;

wherein the prefabricated infilled panel group is disposed in the frame body; the panel group fastener is disposed between left and right sides of a top of the prefabricated infilled panel group and the frame body, and the disc spring assembly is disposed between left and right sides of the lower part thereof and the frame body; each disc spring assembly comprises a disc spring box, a disc spring and a disc spring backing plate; the disc spring box is used for fixed connection with the frame body, and the disc spring is in a pre-pressed state; the disc spring is located in a cavity surrounded by the disc spring box and the disc spring backing plate; and the disc spring backing plate is movably arranged and is in contact with the prefabricated infilled panel group;

the prefabricated infilled panel group comprises a plurality of vertical sub-panels; adjacent vertical sub-panels are connected in a splicing manner; and a top of each of the vertical sub-panels is connected to the frame body via the U-shaped connector, and a bottom of each of the vertical sub-panels is connected to the frame body via a cast-in-place fine stone concrete.

2. The prefabricated infilled panel-frame structure capable of accommodating seismic-loading and seismic energy dissipation according to claim 1, wherein a side wall of each of the vertical sub-panels is provided with a splicing ridge or a splicing groove; and a splicing connection between the adjacent vertical sub-panels is realized by mating of the splicing ridge and the splicing groove.

3. The prefabricated infilled panel-frame structure capable of accommodating seismic-loading and seismic energy dissipation according to claim 1, wherein each of the vertical sub-panels comprises a main board, an damping layer and a secondary board arranged from top to bottom, wherein a bottom of the main board is provided with a semicircular groove; a top of the secondary board is provided with a semicircular ridge; the main board and the secondary board are connected by the semicircular groove and the semicircular ridge; the main board is rotatable along the semicircular ridge at the top of the secondary board; and the damping layer is disposed at a connection of the main board and the secondary board.

4. The prefabricated infilled panel-frame structure capable of accommodating seismic-loading and seismic energy dissipation according to claim 3, wherein a bottom of the secondary board of each of the vertical sub-panels is further provided with a ridge for forming a shear key with the cast-in-place fine stone concrete, the shear key and the U-shaped connector cooperating to limit an out-of-plane displacement of the prefabricated infilled panel group.

5. The prefabricated infilled panel-frame structure capable of accommodating seismic-loading and seismic energy dissipation according to claim 3, wherein the damping layer is made from SBS coiled materials or low strength mortar.

6. The prefabricated infilled panel-frame structure capable of accommodating seismic-loading and seismic energy dissipation according to claim 3, wherein the frame body comprises a frame top beam, a frame bottom beam, a frame left column and a frame right column, wherein the frame top beam and the frame bottom beam are equally long and parallel; and both ends of the frame top beam and both ends of the frame bottom beam are reliably connected to the frame left column and the frame right column, respectively.

7. The prefabricated infilled panel-frame structure capable of accommodating seismic-loading and seismic energy dissipation according to claim 6, wherein a pouring height of the cast-in-place fine stone concrete placed in a space between prefabricated infilled panel frame group and the frame left column or the frame right column is flush with a top surface of the secondary boards of several vertical sub-panels.

8. The prefabricated infilled panel-frame structure capable of accommodating seismic-loading and seismic energy dissipation according to claim 1, wherein the panel group fastener is formed by casting in a formwork the fine stone concrete in a gap between a left upper portion and a right upper portion of the prefabricated infilled panel group and the frame body.

9. The prefabricated infilled panel-frame structure capable of accommodating seismic-loading and seismic energy dissipation according to claim 1, wherein the frame body is a reinforced concrete frame or a steel frame.

10. A method for constructing the prefabricated infilled panel-frame structure capable of accommodating seismic-loading and seismic energy dissipation according to claim 1, comprising the steps of step 1, completing a construction of the frame body;

step 2, installing the plurality of vertical sub-panels in sequence;

step 3, connecting the prefabricated infilled panel group and the frame body by casting fine stone concrete in a formwork;

step 4, installing disc spring assemblies on both sides of a lower portion of the prefabricated infilled panel group; and step 5, performing a flexible connection for a gap between the prefabricated infilled panel group and the frame body.

11. A method for constructing the prefabricated infilled panel-frame structure capable of accommodating seismic-loading and seismic energy dissipation according to claim 2, comprising the steps of step 1, completing a construction of the frame body;

step 2, installing the plurality of vertical sub-panels in sequence;

step 3, connecting the prefabricated infilled panel group and the frame body by casting fine stone concrete in a formwork;

step 4, installing disc spring assemblies on both sides of a lower portion of the prefabricated infilled panel group; and step 5, performing a flexible connection for a gap between the prefabricated infilled panel group and the frame body.

12. A method for constructing the prefabricated infilled panel-frame structure capable of accommodating seismic-loading and seismic energy dissipation according to claim 3, comprising the steps of step 1, completing a construction of the frame body;

step 2, installing the plurality of vertical sub-panels in sequence;

step 3, connecting the prefabricated infilled panel group and the frame body by casting fine stone concrete in a formwork;

step 4, installing disc spring assemblies on both sides of a lower portion of the prefabricated infilled panel group; and step 5, performing a flexible connection for a gap between the prefabricated infilled panel group and the frame body.

13. A method for constructing the prefabricated infilled panel-frame structure capable of accommodating seismic-loading and seismic energy dissipation according to claim 4, comprising the steps of step 1, completing a construction of the frame body;

step 2, installing the plurality of vertical sub-panels in sequence;

step 3, connecting the prefabricated infilled panel group and the frame body by casting fine stone concrete in a formwork;

step 4, installing disc spring assemblies on both sides of a lower portion of the prefabricated infilled panel group; and step 5, performing a flexible connection for a gap between the prefabricated infilled panel group and the frame body.

14. A method for constructing the prefabricated infilled panel-frame structure capable of accommodating seismic-loading and seismic energy dissipation according to claim 5, comprising the steps of step 1, completing a construction of the frame body;

step 2, installing the plurality of vertical sub-panels in sequence;

step 3, connecting the prefabricated infilled panel group and the frame body by casting fine stone concrete in a formwork;

step 4, installing disc spring assemblies on both sides of a lower portion of the prefabricated infilled panel group; and step 5, performing a flexible connection for a gap between the prefabricated infilled panel group and the frame body.

15. A method for constructing the prefabricated infilled panel-frame structure capable of accommodating seismic-loading and seismic energy dissipation according to claim 6, comprising the steps of step 1, completing a construction of the frame body;

step 2, installing the plurality of vertical sub-panels in sequence;

step 3, connecting the prefabricated infilled panel group and the frame body by casting fine stone concrete in a formwork;

step 4, installing disc spring assemblies on both sides of a lower portion of the prefabricated infilled panel group; and step 5, performing a flexible connection for a gap between the prefabricated infilled panel group and the frame body.

16. A method for constructing the prefabricated infilled panel-frame structure capable of accommodating seismic-loading and seismic energy dissipation according to claim 7, comprising the steps of step 1, completing a construction of the frame body;

step 2, installing the plurality of vertical sub-panels in sequence;

step 3, connecting the prefabricated infilled panel group and the frame body by casting fine stone concrete in a formwork;

step 4, installing disc spring assemblies on both sides of a lower portion of the prefabricated infilled panel group; and step 5, performing a flexible connection for a gap between the prefabricated infilled panel group and the frame body.

17. A method for constructing the prefabricated infilled panel-frame structure capable of accommodating seismic-loading and seismic energy dissipation according to claim 8, comprising the steps of step 1, completing a construction of the frame body;

step 2, installing the plurality of vertical sub-panels in sequence;

step 3, connecting the prefabricated infilled panel group and the frame body by casting fine stone concrete in a formwork;

step 4, installing disc spring assemblies on both sides of a lower portion of the prefabricated infilled panel group; and step 5, performing a flexible connection for a gap between the prefabricated infilled panel group and the frame body.

18. A method for constructing the prefabricated infilled panel-frame structure capable of accommodating seismic-loading and seismic energy dissipation according to claim 9, comprising the steps of step 1, completing a construction of the frame body;

step 2, installing the plurality of vertical sub-panels in sequence;

step 3, connecting the prefabricated infilled panel group and the frame body by casting fine stone concrete in a formwork;

step 4, installing disc spring assemblies on both sides of a lower portion of the prefabricated infilled panel group; and step 5, performing a flexible connection for a gap between the prefabricated infilled panel group and the frame body.

* * * * *